United States Patent [19]

Shaftner et al.

[11] Patent Number: 4,474,166

[45] Date of Patent: Oct. 2, 1984

[54] WICK HEATERS

[75] Inventors: Robert F. Shaftner; Michael A. Kagan, both of Bowling Green, Ky.

[73] Assignee: Koehring Company, Brookfield, Wis.

[21] Appl. No.: 390,671

[22] Filed: Jun. 21, 1982

[51] Int. Cl.[3] ..... F24C 5/04

[52] U.S. Cl. ..... 126/96; 126/114

[58] Field of Search ..... 126/96, 265, 37 R, 37 A, 126/37 B, 39 B, 45, 50, 65, 93, 95, 97, 98; 98/114; 431/102, 195, 325, 298, 252, 300, 120; 237/50, 53

[56] References Cited

U.S. PATENT DOCUMENTS

| | | | |
|---|---|---|---|
| 2,284,138 | 5/1942 | Evans et al. | 126/114 X |
| 2,540,877 | 2/1951 | Harney | 126/114 X |
| 3,437,086 | 4/1969 | Phillip | 126/93 X |
| 3,534,724 | 10/1970 | Petz | 126/114 |
| 3,720,154 | 3/1973 | Biggi | 98/114 X |
| 4,020,752 | 5/1977 | Stephan | 98/114 X |
| 4,177,791 | 12/1979 | Marchant | 126/65 |

*Primary Examiner*—Larry Jones

*Attorney, Agent, or Firm*—Jerome P. Bloom

[57] ABSTRACT

A wick heater comprises a housing the top and front panel of which are so constructed and interrelated with each other and the remainder of the housing to provide for their relative expansion and contraction in a manner to avoid warping, buckling or distortion or any undue stress on the housing or its component parts during operation of the heater. The top of the housing comprises a frame and inserts, a principal insert being interconnected with and for expansion and contraction relative to the frame and to position directly above the chimney of the heater and the area encompassed by its backing heat reflecting surface. This principal insert has a unique pattern of slots the bounding edges of which are flanged and a portion of which are oriented in directions at right angles to other of said slots to lend both strength and stress accommodation to the top of the housing. The front panel structure has a slip fit relation to the housing and is connected to the remainder of the housing only in an area adjacent its base. It also has a distinctive profile and mounts a guard the nature, character and interrelation thereof is such to add an important element of safety in use of the heater. The heater has numerous improvements providing a total construction which lends itself to a distinct moderation of the surface temperature of the heater housing.

35 Claims, 12 Drawing Figures

WICK HEATERS

BACKGROUND OF THE INVENTION

This invention relates to design and construction improvements in wick heaters which make them economical to fabricate, more efficient and safer in use and provide them with a longer operating life.

Serious structural and functional problems are exhibited in use of prior art wick heaters. These problems derive, basically, from the inherent direct exposure of a substantial portion of their housing and parts to the source of their developed heat. Experience in use of such heaters has proven that the manner of their construction and the creation and delivery of their heat causes intense stress in and relatively early buckling and warping of their wall structure, particularly in the top and front portions thereof. Also, hot spots are produced in their exterior surface the temperature level of which can be highly dangerous to adjacent persons and property, not only on contact but also by reason of the level and intensity of the resultantly radiated heat.

Another area of concern is that chance tipping or overturn of a prior art wick heater can easily produce a spillage of its fuel in amounts which if hot at the time or ignited could have disastrous consequences.

A most serious problem in the use of a prior art wick heater derives from the fact that its construction, the degree of exposure of its source of heat and its reflective character makes it an "attractive nuisance" to inquisitive adults, children and animals. In this respect attention is directed to the fact that there is a tendency of manufacturers of prior art wick heaters to have vent and inlet openings in those areas of their housings which are immediately adjacent highly dangerous interior components of the heater.

The present invention and the various features of the improvements of the construction of its embodiments deals with and minimizes the need for concern for the above stated problems.

The present inventors are not aware of any prior art which exhibits the particular improvements which they believe to constitute their invention.

SUMMARY OF THE INVENTION

A wick heater embodying the features of the present invention is provided with an improved construction of its housing which not only minimizes the incidence of stress on its parts but accommodates stress where it occurs in a manner to avoid warping, buckling and distortion. Furthermore, the construction and arrangement is such to eliminate the occurrence of intense concentration of heat in any localized spot of the heater housing and to permit critical parts of the housing to thermally expand and contract without adverse side effects. The net result of the composition of the heater of the invention is that outermost surface portions of its housing are maintained during the operation of the heater at a level of temperature which is safer than that heretofore found to exist in the operation of prior art heaters of a similar type.

More particularly, the invention provides that the top of the heater housing is a frame embodying an insert, substantially directly over the wick chimney, in a manner to accommodate a relative expansion and contraction thereof when subjected to intense heat, without danger of its separation from the frame. This insert is provided with a unique slotted construction. The slots are so patterned and constructed as to extend in different directions at right angles to each other and to provide the insert with a substantial three dimensional strength inhibiting buckling, warpage and distortion of either the insert or the bounding portions of its frame.

Preferred embodiments of the invention features a housing the integrated front panel portion of which is preferably made of plastic and mounted in an exceedingly simple manner which permits it to expand and contract, as prevailing circumstances dictate, without adverse effects upon the remainder of the housing. The construction of the front panel is such that it precludes ready access to the fuel and burner portions of the heater. Furthermore, this front panel is so constructed and applied as to not only simply interfit with the top of the housing of which it forms a part but also with the base reflector portion of the heater without need of fasteners therebetween. The front panel further provides for an inobvious inlet for air as may be required to support ignition and combustion of the fuel which is contained within the heater. In the preferred embodiment of the heater housing its side walls are devoid of apertures or slots while its back wall has vent slots but only in safe areas. The latter are utilized for heat control, which in the case of the present invention provides that all critical elements of the heater are modified as to the level of their temperature not only during the heater operation but after its shut down. The result in this respect is a heater which on an overall basis will have a generally safer level of temperature at its outer surface, the highly desirable consequences of which should be readily obvious.

Preferred embodiments of the invention also feature a unique interrelation of a distinctive profile provided for the front panel portion of the heater and that of an improved grill. The construction of these parts is such to insure that should the heater be tipped in a forward direction, the front face of the heater will be maintained at such an angle as to minimize the chance discharge or spillage of fuel from the heater. The safety aspects of this feature of an invention embodiment should be readily obvious to those who are faimilar with the use of the wick heaters of the prior art.

It is therefore a primary object of the present invention to provide a wick heater having a new and improved construction, in particular of its exterior parts, which is not only simple and economical to fabricate but most efficient and satisfactory in use and much safer in operation, as compared to prior art heaters of the same type.

A further object is to provide an improved housing for a wick heater which is strong and highly resistant to warping, buckling and distortion.

Another object is to provide an improved construction for the top of a housing of a wick heater, or any similar structure which in use is subjected to an intense or concentrated application of heat.

An additional object is to provide an improved construction for the front panel of a wick heater.

Another object is to provide an improved construction of the safety grill of a wick heater.

A further object is to provide a housing for a wick heater so constructed as to facilitate control of its temperature and provide for a safer distribution of the heat developed in the operation of the heater of which it forms a part.

An additional object of the invention is to provide features of construction of a wick heater and parts thereof possessing the advantageous structural features, the inherent meritorious characteristics and means and mode of use thereof such as herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawing wherein are shown some but not necessarily the only forms of embodiment of the invention, FIG. 1 is a perspective view of a heater per the present invention, shown with parts of its safety grill broken away for clarity of disclosure;

Like parts are indicated by similar characters of reference throughout the several views.

Figure 1:
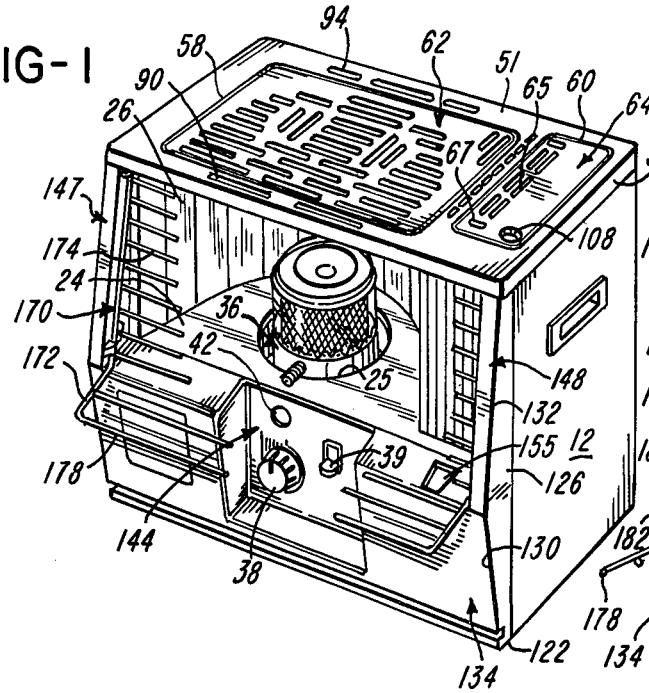
Figure 3:
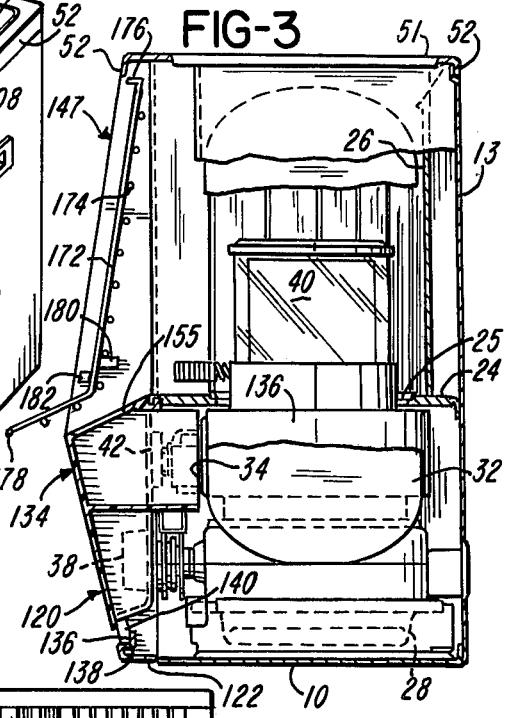
FIG. 3 is a sectional view, parts being shown in fragmentary form to reveal internal detail.
Figure 2:
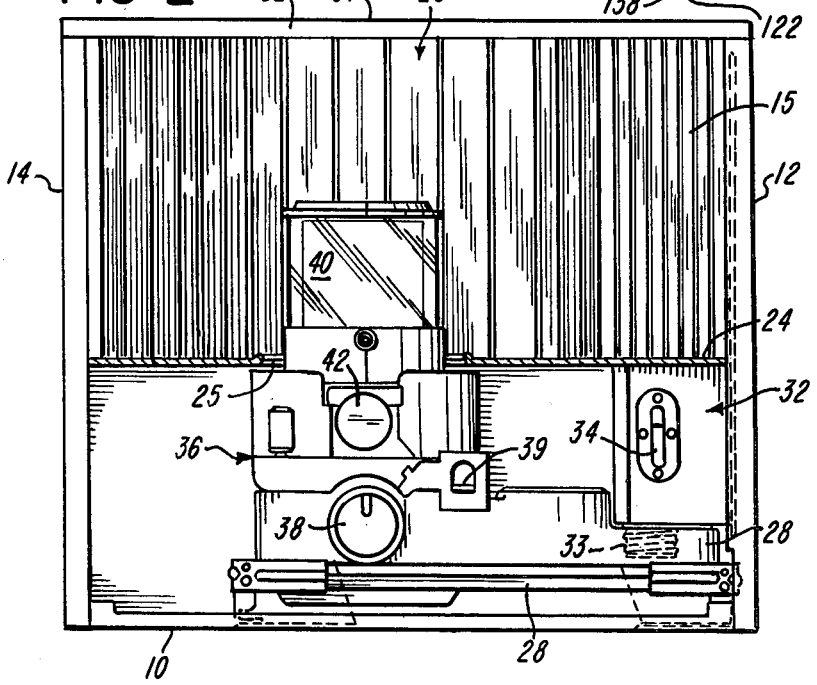
FIG. 2 is a front elevation view thereof the front panel portion of which is removed to disclose details of its interior components.
Figure 4:
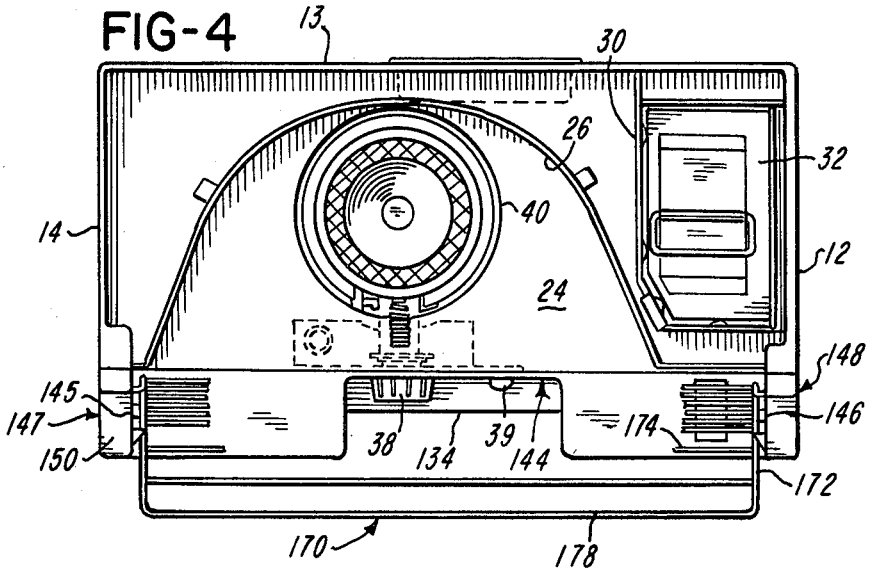
FIG. 4 is a top view wherein the top of the heater housing is removed for disclosure of interior components.
Figure 5:
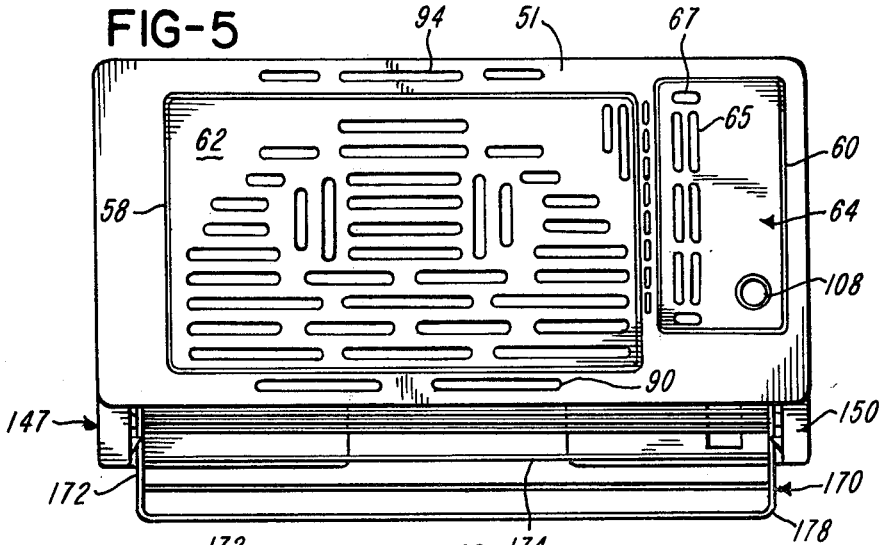
FIG. 5 is a top view of the heater.
Figure 6:
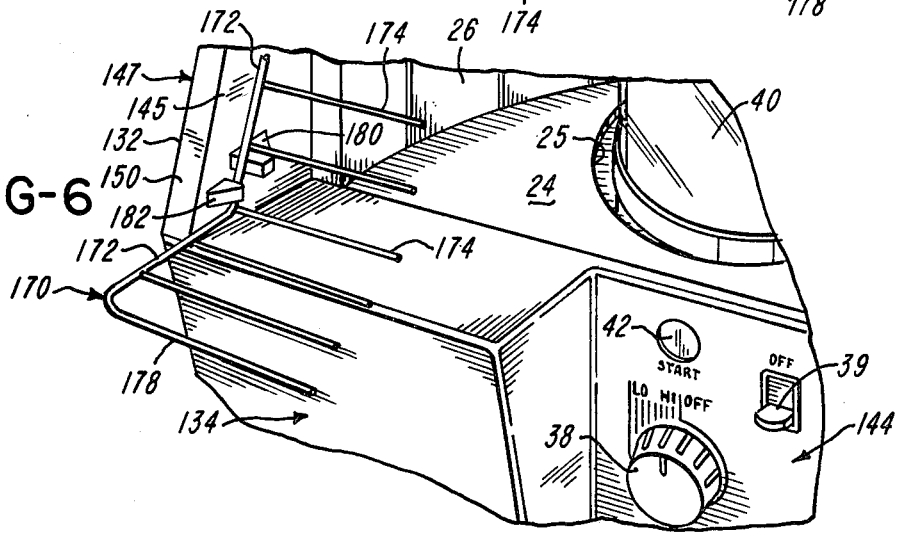
FIG. 6 is a fragmentary view illustrating the latching arrangement for the safety grill.
Figure 7:
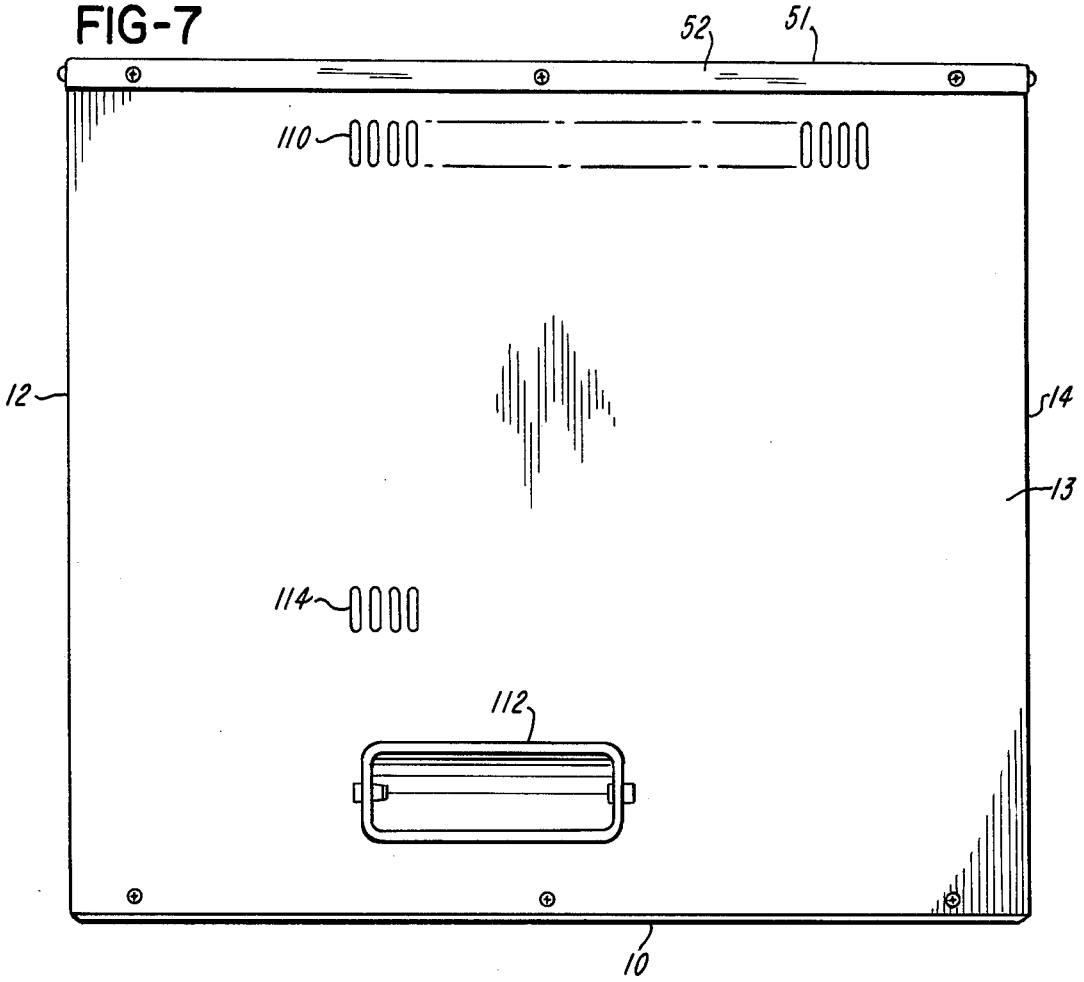
FIG. 7 is a rear elevation view of the heater housing.
Figure 8:
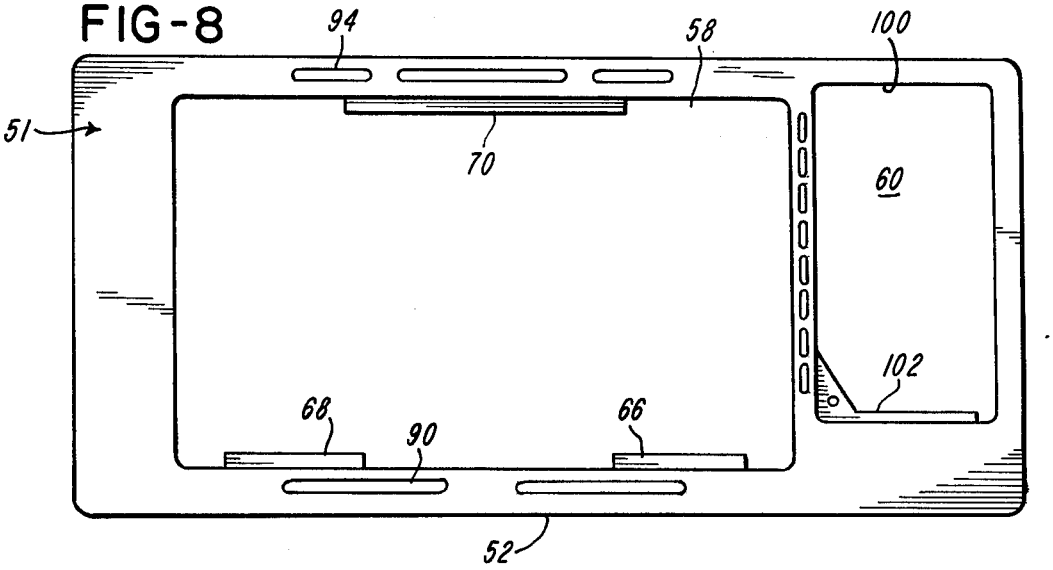
FIG. 8 is an exterior plan view of the frame portion of the top of the heater housing.
Figure 9:
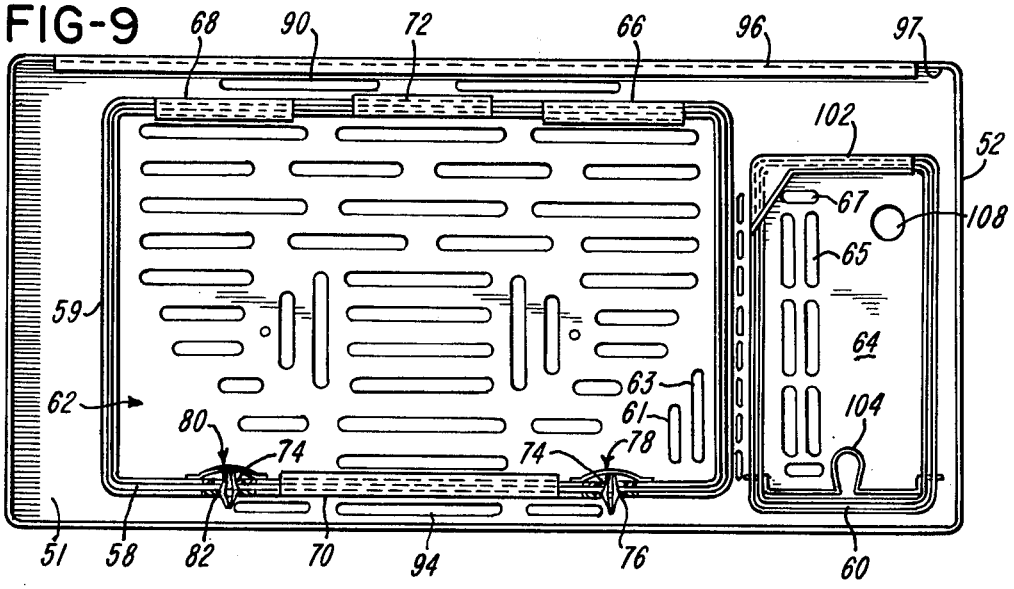
FIG. 9 is a view of the underside of the assembly providing the top of the heater housing.

The accompanying drawings show preferred embodiments of the invention wherein the base or floor of the heater housing illustrated is provided by a generally rectangular plate 10 along the bounding side edges of which are integral, upstanding, perpendicularly projected flange portions. The back 13 and side walls 12 and 14 of the housing are formed from a single plate element which is appropriately bent to wrap around and be secured, at its lower end, to the flange portions at what might be considered the back and side edges of the base plate 10. As so secured, the back and side walls rise upwardly from and perpendicular to the base 10 to form therewith a rectangular shell portion of the heater housing which is open at its top and to the front thereof.

The interior of the above described shell is bridged by a horizontally disposed plate 24 which is positioned in a plane spaced upwardly from and parallel to the plane of the base 10.

The plate 24 is formed of highly reflective sheet metal. It includes integral dependent flange portions abutted and suitably secured in a fixed relation to portions of the inner wall surface of the side walls 12 and 14 and the back wall 13. What may be considered as the front edge of the plate 24 has a substantially coextensive dependent flange which is in a plane commonly occupied by the front edges of the side walls 12 and 14.

A second plate 26 of highly reflective sheet metal material is edge mounted to extend upwardly from and perpendicular to the plate 24, substantially to the plane of the co-planar upper edge portions of the side walls 12 and 14 and the back wall 13. The plate 26 is uniformly parabolic in horizontal section. The lowermost edge of the plate 26 is provided with spaced tab-like projections which are thrust through slots in the base plate 24 and suitably bent thereunder to fix the plate 26 in its perpendicularly projected relation to the plate 24.

The plate 26 thus provides an outwardly facing heat reflective vertical wall surface of uniformly parabolic horizontal section the rounded apex of which lies inwardly of the shell adjacent the back wall 13 and the sides of which diverge in a direction outwardly therefrom to the plane commonly occupied by the front edge of the plate 24 and the front edges of the side walls 12 and 14.

With respect to its lateral position, the plate 26 is offset to have one vertical side edge thereof in immediately adjacent laterally spaced relation to the front edge of the side wall 14. This edge of the plate 26 has an integral external flange coextensive therewith which overlies and is abutted and secured to a projection from the inner surface of the side wall 14. The offset of the parabolically configured plate 26 toward the side wall 14 positions it clear of a generally rectangular cutout in the edge of the plate 24 immediately adjacent the side wall 12. The vertical edge of the parabolically configured plate 26 most adjacent the side wall 12 has a coextensive integral extension 15 which bridges the space between it and the side wall 12, adjacent the latter of which it is fixed in overlying abutted relation to a projection from the inner surface of the wall 12.

The plates 24 and 26 thus provide a reflector assembly which extends from side wall to side wall of the heater housing above the plate 24 and from the plate 24 to the upper limits of the side and back walls 12, 13 and 14.

The plate 24 has a large aperture 25 therein, formed on a uniform radius, which is laterally centered within the outwardly facing parabolic surface portion of the plate 26 and located in an immediately forward, spaced relation to its apex. The aperture 25 is rimmed by a shallow vertically orienting flange.

Contained within the aforementioned shell, in the space bounded by the plate 24 and the base plate 10 and side walls 12 and 14, is a tank defining a sump 28 holding a supply of kerosene providing fuel for the heater. The sump 28 seats on and within the limits of the base 10 and has a portion of reduced depth which underlies the cutout in the plate 24 adjacent the side wall 12. Fixed to and upstanding from the plate 24, in rimming relation to the cutout and in connection with the back wall 13 and the side wall 12, is a guide structure 30. The guide 30 provides a vertical frame the cross section and construction of which is complementary to that of a small fuel supply tank 32 which slip fits therein, from the top thereof, to project adjacent to a notch in the plate 24 and have what might be considered its discharge end seat to the top of the sump about an inlet opening thereto. The discharge end of the tank 32 has an opening rimmed by a projected tubular boss 33 which on application of the tank depends within the inlet opening of the sump to present its valved discharge opening to the sump interior. At the same time a fuel gage 34 fixed to form a part of the tank 32 at one side thereof immediately above its discharge opening is exposed for reading at a position below the level of the plate 24.

The sump has an opening in the top thereof at its end remote from the supply tank, at a location which immediately underlies the aperture 25 in the plate 24. Protruded through this opening is a burner unit 36 which mounts a wick assembly, the wick of which is immersed in fuel in the sump.

The wick can be suitably elevated to a position within the burner unit wherein the fuel therein can be ignited to produce a flame. This elevation is achieved through a suitable ratcheting arrangement the drive shaft of which has a control knob 38 positioned outwardly of the burner unit at the front of the heater housing. A clockwise rotation of the knob 38 serves to raise the wick from its lowermost immersed relation to the fuel in the sump to an elevated position wherein the fuel therein may be ignited and burned.

A trip latch is provided to lower the wick from its elevated operating position as and when desired, in the process of which any flame that might exist is extinguished. The trip latch is under the control of a finger operated release lever 39 a portion of which projects outwardly of the burner unit and the front of the heater housing to be readily accessible at a location adjacent and slightly spaced from the knob 38. A push button 42 similarly accessible adjacent both the knob 38 and the lever 39 has a direct connection with an outwardly biased igniter device. On movement of the igniter device radially inward of an opening in the generally cylindrical tubular configuration of the burner unit the electrical resistance wire thereof is projected into an immediate relation to the wick, provided that it is elevated at the time, and then energized to cause the wire to glow. This ignites the fuel in the wick and produces a burning thereof and a resultant flame.

A chimney device 40 seated to the burner unit 36 projects upwardly therefrom, about and in a concentrically spaced relation to the wick and within and spaced from the flange rimming the opening 25. The chimney 40 encompasses and contains, in a peripheral sense, the flame developed of igniting the fuel within the wick. The heat of combustion which results is channelled from and directed peripherally of and also outwardly from the chimney to be dissipated and reflected in a manner which should be obvious.

It will be seen that none of the components including the tank 32, its guide structure 30, the sump 28, the burner unit 36, the chimney 40 or the means for controlling the position of the wick, the ignition of the fuel therein or damping of the flame produced on burning of the fuel are described or shown in any detail. This is due to the fact that in and of themselves these elements and the construction and arrangement of their controls form no part of the present invention. Such may be variously contrived by those versed in the heater art. The purpose and limited description and showing of these parts and reference thereto is simply to the extent necessary to enable a clear understanding of the structure and function of the improvements in a wick heater or like device as provided by the present invention.

The upper edges of the side walls 12 and 14 and the back wall 13 seat a rectangular plate 51. The outer peripheral edge of the plate 51 is bounded by a vertically dependent flange 52. Portions of the flange 52 abut and are releasably secured to inwardly offset upper outer surface portions of the back and side walls of the housing so the exposed surfaces of the back and side walls and the overlapping flange 52 are flush. The flanged plate 51 is so sized and arranged that a limited portion thereof projects forwardly of the frontal plane of the housing shell, which is defined by the front edges of the side walls 12 and 14 and the base 10. The flange 52 is formed so its front portion inclines downwardly and forwardly of the front edge of the plate 51 at an oblique angle thereto.

The plate 51 has two rectangular apertures 58 and 60, one (58) being larger than the other (60).

Aperture 58 has one side edge thereof in adjacent, parallel, spaced relation to the side wall 14 and extends a substantial portion of the side to side dimension of the housing to have its opposite side edge in adjacent, parallel, spaced relation to one side edge of the aperture 60, the opposite side edge of which is in an adjacent, parallel, spaced relation to the side wall 12 of the heater housing. The front and back edges of the aperture 58 are respectively in adjacent, parallel, spaced relation to the front and back edges of the plate 51 at the top of the heater housing. The back edge of the aperture 60 is in a closely adjacent, parallel, spaced relation to the back edge of the plate 51 while the front edge of the aperture 60 is parallel to but has a substantial spacing from the front edge of the plate 51.

The aperture 58 is rimmed by a vertically dependent flange 59 formed integral with the plate 51. The flange 59 is so sized and arranged that an extension thereof would immediately bound the front to back and side to side limits of that portion of the vertical reflector plate 26 which is parabolically configured in horizontal section. Two rectangular tabs 66 and 68 are formed integral with and spaced along the length of what may be considered the lower edge of the front portion of the flange 59, equidistance from its ends. The tabs 66 and 68 project inwardly of the aperture 58 in a plane parallel to that occupied by the plate 51. The opposite or back portion of the flange 59 has a single tab 70 formed integral therewith and perpendicular thereto at a central portion of its lower edge. The tab 70 projects inwardly of the aperture 58 towards and in a plane commonly occupied by the tabs 66 and 68. Tab 70 is also directly opposite and somewhat longer in length than the space between the tabs 66 and 68.

Tabs 66, 68 and 70 serve to seat the lower edge of a vertically dependent flange bounding the outer peripheral edge and forming a part of a plate insert 62, the outermost surface of which is thereby positioned coplanar with the plate 51. The bounding peripheral edge of the inert 62, which is appropriately configured and dimensioned, is initially established in a concentric spaced relation to the flange 59.

The insert 62 has a rectangular tab 72 formed integral with, perpendicular to and centered between the ends of what may be considered the front portion of its dependent flange, at its lowermost edge. The tab 72 projects outwardly of the insert to underlie the front portion of the flange 59, at a location normally centered between and spaced from the tabs 66 and 68 as the insert is fitted within and in centered relation to the aperture 58.

The rearmost or back portion of the flange of the insert 62, which seats to the tab 70, is provided with a pair of longitudinally spaced apertures 74, one of said apertures being in an adjacent, spaced relation to each of its remote ends. In the installation of the insert 62, the apertures 74 are each aligned with a separate smaller aperture 76 in the back portion of the flange 59. This provides two pairs of aligned apertures 74, 76. A spring clip 78 is applied to each pair of aligned apertures 74, 76. Each clip 78 has an arcuately configurated head 80, flats at either end of which seat to the inner surface of the back portion of the flange of the insert 62 to position its concave surface most adjacent the flange with the apex thereof in a direct alignment with the apertures 74 and 76 to which the clip applies. Connected at one end to the apex of the concave surface of the head 80 and projected radially therefrom is a pair of divergent-convergent spring fingers 82. The spring fingers 82 are sized so the most divergent portions thereof pass freely through the aperture 74 with clearance with respect to its bounding edge. The outermost convergent end portion of the fingers 82 project through the aligned aperture 76 and bias against and frictionally engage to its bounding surface.

The seating and bearing relation of the insert 62 to the tabs 66, 68 and 70, and through the medium of tab 72 to the flange 59, and the normal freedom and spacing as provided between the fingers 82 and the flange of the insert 62 enables an expansion and contraction of the insert 62 within the aperture 58 and with respect to its frame, defined by the plate 51 and its flange 52, without stress in any respect on the frame or on the insert. As will be seen, the construction of the frame 51, 52 and its inserts avoids perceptible bowing, warping or buckling thereof and correspondingly avoids the referral of stress to other parts of the heater housing during the course of the heater operation.

Within its bounding flange, the plate insert 62 is provided with a multitude of apertures, each of which is bounded by a relatively shallow similarly dependent flange. Except for two thereof (61, 63) these apertures are arranged in a pattern generally aligned with and corresponding generally in size and configuration to the area of the plate 24 bounded by the heat reflective, outwardly facing surface of the plate 26. Therefore, in effect, the boundary line of said pattern of apertures, which extends from immediately adjacent the back to the front edge of the insert 62 has a substantially parabolic configuration. Within this substantially parabolic outline, the majority of the apertures are slots which extend transverse thereto, in rows which are in a generally parallel spaced relation to each other and to the front and back edges of the insert 62. The slots vary in length and spacing. Except for a single slot in the back row thereof, at the apex of the pattern of slots, each row is comprised of a plurality of said slots defining a line wherein the slots are in an end spaced relation. In the pattern illustrated there are differences in the spacing between the slots in some of the rows, primarily in the rows more closely adjacent the apex of the pattern. In other of said rows, to the end of said pattern remote from said apex the slots in each thereof are offset from the slots in adjacent of said rows so that the slots overlap spaces between slots in adjacent of said rows.

Also included within the aforesaid pattern of slots in the insert 62, adjacent and spaced from the apex of the pattern, are two groups of apertures each comprised of two elongate slots which differ in length and a small aperture the bounding edge of which is formed on a uniform radius. These groups are symmetrically arranged with one group spaced to each of the opposite sides of the center of said pattern. The slots in each of said two groups thereof are oriented in a parallel spaced relation and extend in a direction which is at right angles to the front and back edges of the insert 62. The aperture in each of the two groups is so positioned and related to the slots therein as to give an observer the impression of a pair of symmetrical triangles the apex portions of which are relatively remote and define a line intermediate adjacent rows of said slots which are in a parallel spaced relation to each other and to the front and back edges of the insert 62.

Apertures 61, 63 are located in the rearmost corner of the insert 62 most adjacent the aperture 60.

The plate 51 has two longitudinally spaced vent slots 90, of equal length, arranged in a line parallel to, spaced from and slightly forward of the line of the front portion of the flange 59, as well as three longitudinally spaced vent slots 94, which differ in length, arranged in a line parallel to, spaced from and intermediate the back portions of the flange 59 and the flange 52. Each group of slots 90 and 94 is relatively centered within the side to side limits of the aperture 58.

A flange 96 formed integral with the inner surface of the front portion of the flange 52, at its lower edge, is directed inwardly therefrom in a plane substantially parallel to that of the plate 51. The flange 96 runs almost the length of the lower edge of the front portion of the flange 52 and its side edges, which define its respective ends, terminate equidistant from and parallel to the adjacent side portions of the flange 52. The effect of the flange 96 is to provide a pocket to either end thereof at the bottom of the top portion of the housing which projects forwardly of the plane defined by the forwardmost edges of the side walls 12 and 14 and the base 10. The plate 51 also has a line of longitudinally spaced short slots positioned between and parallel to portions of the immediately adjacent parallel sides of the apertures 58 and 60.

The aperture 60 is rimmed by a flange 100 which depends from and perpendicular to the plate 51 and, in turn, has a flange 102 formed integral with and projected inwardly from its front portion and an adjacent side portion thereof, at its lowermost edge. The flange 102 is in a plane spaced below and in parallel relation to the outer surface of the plate 51. The side portions of the flange 100 are provided with a pair of transversely aligned apertures adjacent and spaced forwardly of the back ends thereof. These apertures accommodate the projections therethrough of the respective ends of a formed spring wire 104 which project through and outwardly of the respective side portions of a flange formed integrally with and vertically dependent from the bounding edge of a rectangular plate 64, to one end thereof. The plate 64 is hinged by the spring 104 to normally seat its end remote from its hinge to the flange 102. The sides, connection and mount of the plate 64 is such to establish it, when seated, in a concentric slightly spaced relation to the flange 100. As so applied the plate 64 provides a door which can be lifted upwardly of its frame 51, 52 to enable the insertion or removal of the fuel supply tank 32 previously described. Once the fuel tank 32 is properly positioned, the door 64 is closed, whereupon its outermost surface is substantially flush with the outermost surface of the plate 51.

Eight slots 65 are formed in the plate insert 64. Six of these slots are arranged in pairs, the slots in each pair being parallel and the pairs thereof being in a line and spaced from the front to the back of the plate 64. Spaced beyond each of the respective ends of the line of paired slots and at right angles to the line thereof is a short slot 67. An aperture 108 is formed in the front corner portion of the insert 64 most adjacent the side wall 12 of the heater. The aperture 108 is formed on a uniform radius the size of which permits the insertion of a finger to lift and hinge the insert 64 upwardly and outwardly from the frame defined by the plate 51 and its flange 52, as and when required for insertion or removal of a fuel tank 32.

A line of equidistantly spaced vertically oriented slots 110 is provided in the back wall 13 of the heater housing to open to the space immediately to the rear of the plate 26, at a location adjacent and spaced from its uppermost limit. A battery receptacle 112 is fit in an aperture in the back wall 13 adjacent the base 10, in a position relatively centered with respect to the side walls 12 and 14 but slightly offset in the direction of the wall 12. The receptacle 112 defines a cavity within which batteries mount to place them in a suitable circuit for energizing the igniter device. The details and character of such a circuit, being well known, are neither shown nor described.

A second group of parallel vertically oriented slots 114 is formed in the back wall 13, in an immediate adjacent relation to the receptacle 112. The slots 114 open to the interior of the housing to the rear of the burner unit 36 and the sump 28. These slots as well as the slots 110 serve useful purpose in that they provide vents from the housing interior which lead to the moderation of its temperature. The apertures in the plate 51 and the insert 64 as well as those in the insert 62 likewise contribute to the moderation of the temperature of the heater housing, as well as serving additional functions leading to the preservation of the housing as well as improvements in the efficiency of the operation of the heater of which they form a part.

The front of the heater housing is provided by a contoured panel 120 which is a molded plate structure formed of plastic to have a shell-like configuration. As viewed in front elevation, the panel 120 has a laterally expanded generally rectangular "U" shape. The bridging plate section 134 of this "U" shape is formed to cap that portion of the opening at the front of the shell bounded at its vertical limits by the base 10 and the reflector plate 24 and at its lateral limits by the portions of the side walls 12 and 14 which extend therebetween. The arms 147 and 148 of the panel 120, which project upwardly from and perpendicular to the lateral extremities of the bridging portion of its "U" shape, are narrow. The uppermost ends of the arms 147 and 148 are stepped and thereby reduced in cross section so they may be slip fit in those pockets formed in the bottom of the overhanging portion of the flange 52 at the respective ends of the flange 96.

More particularly, the plate structure of the panel 120 is formed to include a narrow, elongated, generally rectangular base 122. In application of the panel, to form the front of the heater housing, its base 122 has its rearmost edge abutted to and coextensive with the width of the front edge of the flanged base 10 and provides a forward extension thereof. The panel also includes side plate portions 124 and 126, which are parallel and in a transversely aligned relation. The sides 124 and 126 are formed integral with and rise perpendicular to the panel base 122 at its lateral extremities. The rearmost edges of the sides 124 and 126 are in lines perpendicular to the panel base 122 and in the application thereof abut the front edges of the side walls 12 and 14, respectively. At the same time the outer surfaces of the sides 124 and 126 provide forward extensions of the outer surfaces of the side walls 12 and 14.

As the panel 120 is viewed in side elevation, it will be seen the front or forwardmost edges of its sides 124 and 126 each form a line 128 comprised of two straight line sections 130 and 132 which define therebetween an included angle of approximately 150° . The lower section 130 slopes upwardly from and outwardly of the front edge of the base 122 to form therewith an angle of about 105°, to the level of a horizontal plane just below and parallel to the horizontal plane occupied by the heat reflective upper surface of the plate 24. At this point the section 130 connects to the lowermost end of the straight line section 132 which angles upwardly and inwardly therefrom to terminate in the plane of the uppermost end of the panel 120 commonly occupied by the uppermost or projected extremities of the arms 147 and 148.

The portions of the front edges of the panel sides 124 and 126 defined by the line sections 130 are bridged by an integrally connected plate section 134. The lower edge of the plate section 134 is connected to and coextensive with the front edge of the panel base 122. A narrow strip portion 136 of the front surface of the plate section 134 spaced immediately above and parallel to its lowermost edge is recessed. The recessed surface portion 136 faces outwardly of and extends the width of the front of the heater housing. The surface portion 136 projects upwardly from and perpendicular to a ledge 138 which is parallel to the panel base 122 and extends from the lower edge of the surface portion 136 to the outermost surface of the plate section 134. In forming of the recessed surface portion 136 what would normally be the bounding upper side wall thereof, opposite the ledge 138, is eliminated to produce thereby an aperture 140. The aperture 140 so defined is downwardly extended to provide that a portion thereof is visible at the front of the housing above the upper limit of the recessed surface portion 136. A series of small, appropriately shaped, parallel, transversely spaced, reinforcing plates 142 are fixed in edge mounted, interconnected, perpendicular relation to the ledge 138, the recessed surface portion 136 and the back of the plate section 134.

A portion 144 of the plate section 134 centered between the sides 124 and 126 and extending upwardly from a line spaced immediately above and parallel to the line of the recessed surface 136 is offset inwardly from the outermost surface of the plate section 134 to a plane immediately adjacent and forwardly of that plane defined by the vertical, innermost edges of the sides 124 and 126.

The lateral extent of the offset portion 144 is about one-third the total lateral extent of the plate section 134. The portion 144 has three apertures therein. One of these apertures is in line with and accommodates the projection therethrough of the drive shaft for elevating the wick the outwardly projected end of which mounts the control knob 38. The other two apertures respectively accommodate the projection therethrough of the finger operated end of release lever 39 and the exposure of the push button 42 which provides for the inward movement of the igniter.

The front surface portions 150 of the panel arms 147 and 148 lie in a plane commonly occupied by the front edge portions of the sides 124 and 126 defined by their line sections 132. The front surface portions 150 have their lower ends integrally connected with and merge with the plate section 134 at a line defining the juncture of the planes respectively defined by the upper line sections 132 and the lower line sections 130 at the front edges of the sides 124 and 126. To either side of its offset portion 144 the plate section 134 has a relatively angled extension which extends upwardly and inwardly thereof to terminate in a line adjacent the front edge of the horizontal heat reflective plate 24. The remote sides of this upward and inward extension of the plate section 134 are connected integrally with the adjacent facing sides 145 and 146 of the arms 147 and 148. At the same time, the offset portion 144 of the plate section 134 is vertically extended and terminates at its upper end in a flange which is in line with and integrally connected to form a part of the upper edge of the extension of the plate section 134 to either side thereof.

Hook-like projections 151 are formed integral with and spaced longitudinally of the rearmost surfaces of the upper edge portion of the extensions of the plate section 134 and its offset portion 144. These hook-like projections are in a line transverse to the panel 120 and parallel to its base. In the assembly of the panel 120 the hook-like projections 151 commonly receive and have slip fit therein the front portion of the flange in connection with and dependent from the front edge of the plate 24 at the same time as the uppermost ends of the arms 147 and 148 are slipped iinto the pockets at the respective ends of the overhanging portion of the flange 52. The uppermost portions of the arms 147 and 148 are reduced in cross section in a manner to form thereon a shoulder at their front and outer side surfaces. These shoulders face upwardly to engage dependent edge portions of the flange 52 at the front corners thereof in the assembly of the panel 120 to form the front of the heater housing. The shoulders so provided determine the extent to which the arms 147 and 148 may be inserted within the overhanging portion of the flange 52.

Due to the molded character of the panel 120 its arm portions are hollowed and open to the rear thereof. The arms 147 and 148 are therefore comprised of parallel sides respectively provided by a portion of one of the panel sides 124 or 126 and one of the sides 145 or 146.

The only fasteners applied to connect the panel 120 to the rest of the heater housing is a single pair of screws 153. One screw 153 is applied through an aperture in each of the respective ends of the recessed surface portion 136 to engage into a flange portion of the base 10 and thereby couple the panel 120 to form a part of the heater housing. The screws 153 are applied after the panel 120 is slip fit to lodge the upper ends of its arms 147 and 148 within the pockets in the overhanging portion of the top of the housing, the hooks 151 are slip fit to lodge therein the front flange portion of the plate 24 and the apertures in the recessed surface portion 136 are aligned with the appropriate apertures in the flange portion of the base 10. By virtue of the limited fixed connection of the panel 120 and a degree of clearance as between the upper ends of the arms 147 and 148 and the limits of the pockets 97 into which they project and the hooks 151 and the flange on the plate 24, the panel itself is relatively free to expand and contract and to accommodate expansion and contraction of the remainder of the housing should such occur. This taken together with the freedom of stress further insured by the nature and interrelation of the frame 51, 52 and the position and nature of the inserts 62 and 64 avoids any undesirable stress on the various portions of the heater housing and the interrelated parts of the heater. This insures a preservation of the integrity of the heater and optimal efficiency in use thereof.

A generally rectangular aperture 155 is formed in the upwardly and inwardly inclined extension of the plate section 134 adjacent the arm 148 at the side 12 of the heater housing. In connection with the back of the plate section 134 and in rimming underlying relation to the aperture 155 is a channel member 157 extended to project rearwardly from the plate section 134 and frame the fuel gauge in connection with the fuel supply tank 32. The aperture 155 thus provides visual access to the gauge 34, facilitating a determination of the level of the contents of the fuel supply in the tank 32 at all times.

Figure 11:
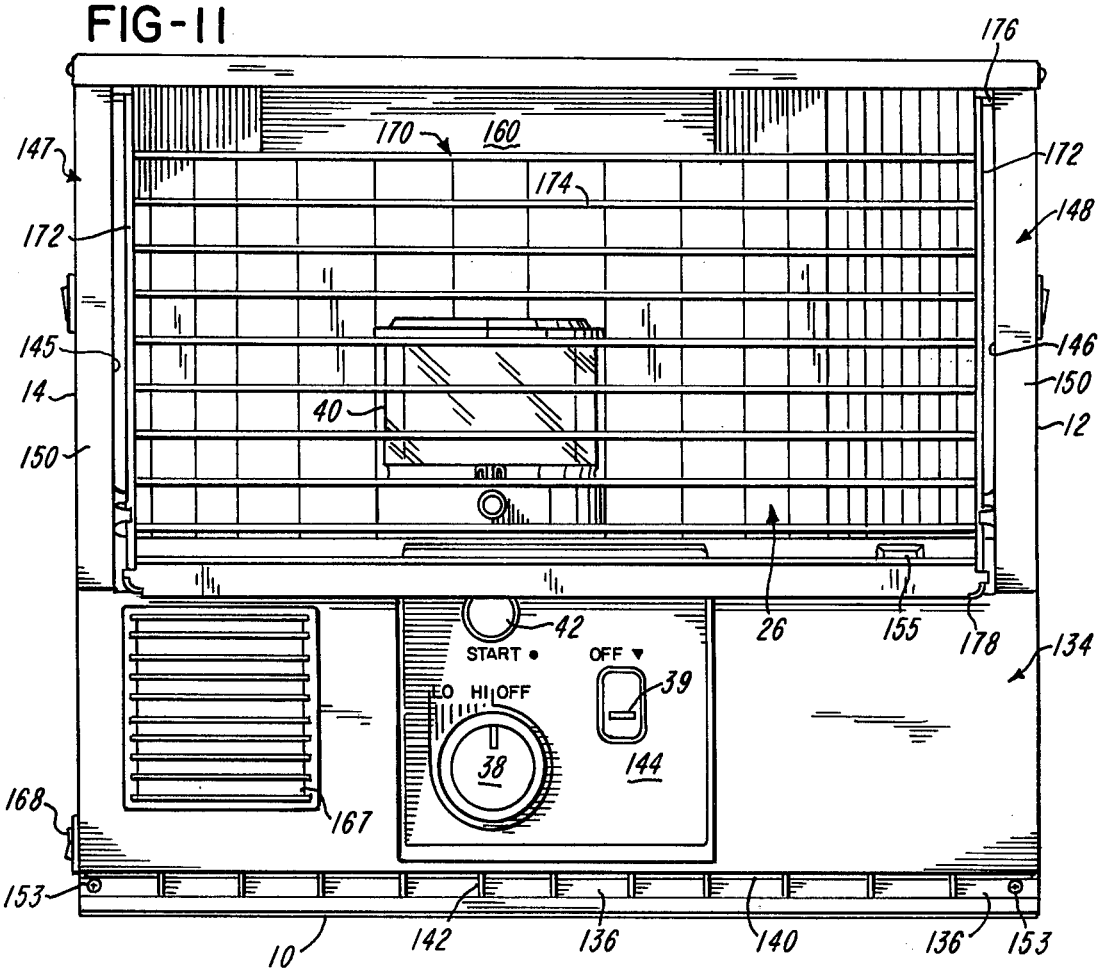
FIG. 11 is a front elevation view of a modification of the heater of FIGS. 1–9.
Figure 10:
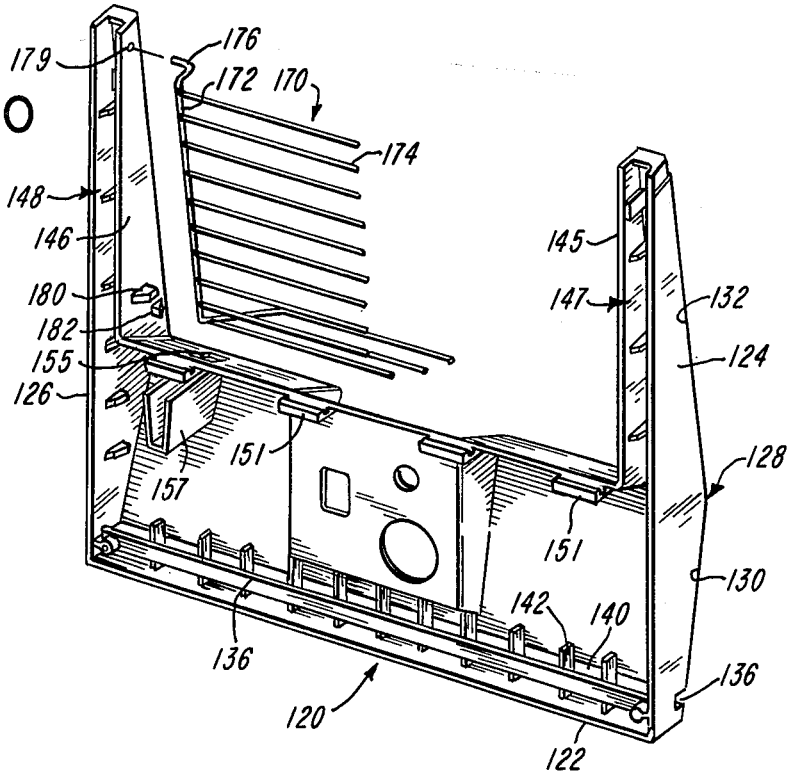
FIG. 10 is a perspective view of the front panel portion of the heater housing taken from the inner side thereof illustrating also, in an exploded relation, a detail of the grill applied in connection with the panel.
Figure 12:
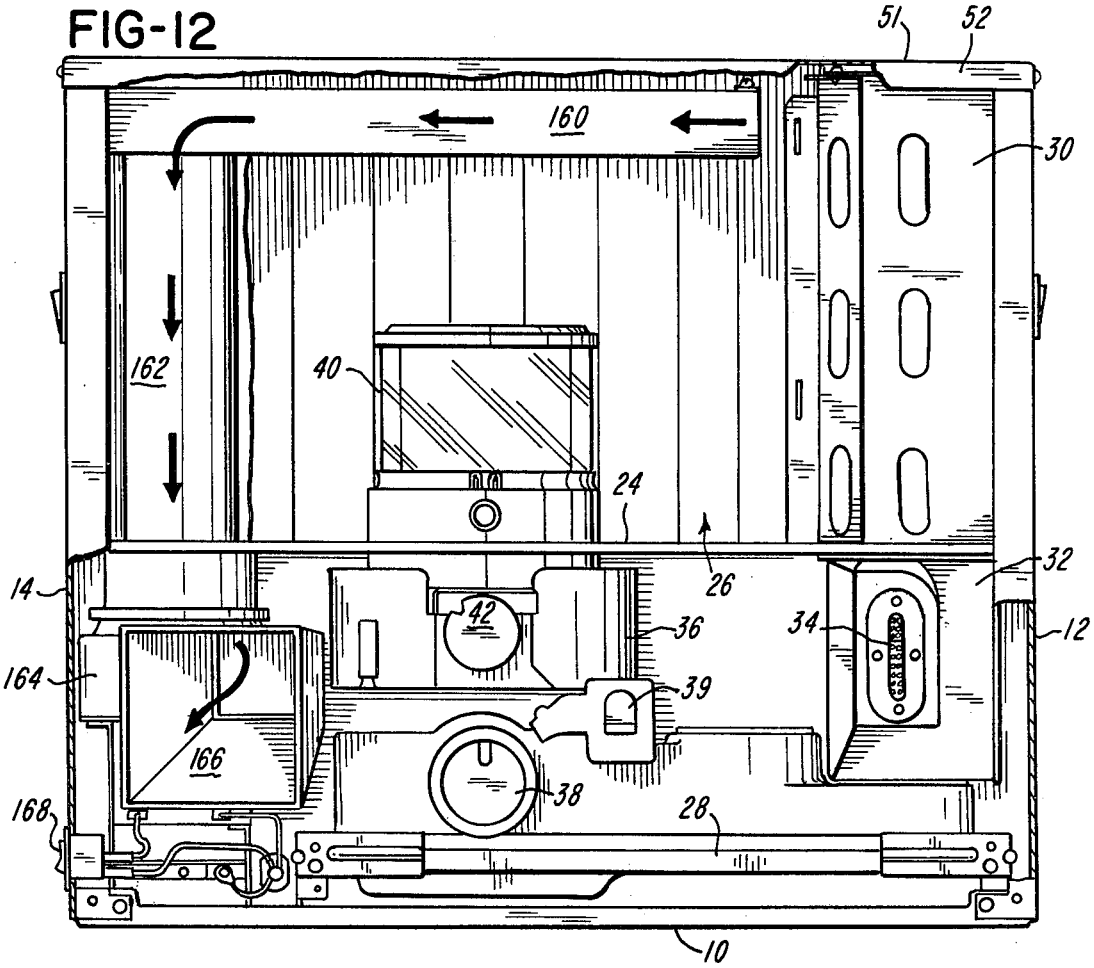
FIG. 12 is a front elevation view of the embodiment of FIG. 11 wherein the grill and front panel portions thereof have been removed to show interior detail, parts being broken away for clarity of disclosure.

FIGS. 11 and 12 of the drawings exhibit a modification of the embodiment of the invention shown in FIGS. 1 through 11 to incorporate therein a blower system. Other than for the necessary changes occasioned by the inclusion therein of the blower system, the heater of FIGS. 11 and 12 is identical in all respects with the heater of FIGS. 1 through 11 and may be referred to for identification of parts described with reference to the embodiment of FIGS. 1–11 and vice versa. Therefore, like parts are identified by like numerals.

FIG. 12 affords a generally diagrammatic illustration of the inclusion of the blower system in a heater in accordance with the invention. As there shown the system includes a generally rectangular upper duct section 160 which is mounted to be in parallel, adjacent, spaced relation to the top of the heater housing. The duct section 160 extends through transversely aligned apertures in the plate 26 to have an intermediate portion of the length thereof, adjacent its air inlet end, positioned in bridging relation to the plate 26 immediately forward of the apex of its outwardly facing heat reflective surface. At its end remote from its air inlet end and at a location outwardly of the parabolic section of the plate 26 the duct section 160 has connected thereto and in communication therewith a vertically dependent tubular duct section 162 which is in parallel adjacent relation to the side wall 14 of the heater housing. The duct section 162 passes through an aperture in the plate 24 and below the aperture connects by means of an adapter section to the inlet of a blower unit 164. The discharge side of the blower unit 164 connects to one end of a generally horizontal expanding duct section 166 which at the terminal end thereof, which abuts the back of the plate section 134 of the panel 120, is rectangular in cross section. The discharge end of the duct section 166 rims a slotted opening 167 in the panel section 134. A circuit is provided for the energization of the blower unit 164, which is under the control of a switch 168, made accessible at the side 14 of the heater housing.

As will be obvious, FIGS. 11 and 12 illustrate the addition of apparatus to the first described embodiment of the invention which serves to provide for a pressured flow of heated air from the wick heater. The inlet end of the duct 160 is made to suitably communicate, by apertures or otherwise, with the slots 110 in the back wall 13 of the heater housing. Thus, as the blower unit is energized by operation of its control switch 168, air is drawn into the heater housing and into and through the duct 160. In the process of movement of this air through the portion of the duct 160 which bridges the plate 25, this portion of the duct is exposed to the intense heat developed in the burning of the fuel in the wick, the concentration of which heat is intensified by the heat reflective capabilities of the plates 24 and 26 and the pattern and position of the apertures in the insert 62 which influence an upwardly directed movement of heat to and about the portion of duct 160 which is substantially over and in a relatively adjacent relation to the chimney 40. As will be obvious, there is a highly efficient heat transfer as between the heat developed in the wick heater and the air moving through the duct 160. The heated air so created in the duct 160 is drawn by the blower unit 164 to move to and through the tubular duct section 162 and the blower unit and to discharge from the heater by way of the duct section 166 and the slotted portion 167 of the panel plate section 134. The total of the developed heat is effectively distributed. A portion of the heat which is not transmitted to the duct work of the blower system is reflected outwardly from the front of the heater housing by the natural action of the plates 24 and 26. The remainder rises outwardly of the housing from the top thereof, primarily through the apertures in the plate insert 62.

In accordance with the teachings of the preferred embodiments illustrated, the opening at the front of the housing of each thereof which exposes the heat reflective surfaces of the plates 24 and 25 as well as the chimney 40 is bridged by a safety guard 170. The guard 170 comprises a sturdy wire bent into a generally U-shaped frame 172 the projected ends of the arms of which include right angled hook-like extremities 176 which project forwardly and then laterally outward of the arms to provide transversely spaced directly aligned pivot studs. These pivot studs are adapted to be slip fit in a pair of transversely aligned apertures 179 formed in the sides 145 and 146 of the panel arms 147 and 148, adjacent their outer ends. The laterally spaced apart arms of the frame 172 are bridged by longitudinally spaced transversely disposed rods 174 which are welded to position at right angles thereto. A short portion of the length of the guard at its end remote from its pivoted connection to the arms 147 and 148, including the base or bridging portion of its U shape and joining end portions of its arms which are bridged by rods 174, is bent outwardly at an oblique angle to its upper preceding portion.

Each of the opposing inner sides 145 and 146 of the arms 147 and 148 is provided with a pair of projections 180 and 182 in identical locations adjacent its innermost end. The arrangement is such that the projections 180 are transversely aligned, as are the projections 182. Furthermore the projections 180 are offset slightly upward and rearward of the projections 182.

The effect of the placement and arrangement of the projections 180, 182 is to provide the arms 147 and 148 with transversely aligned latches between the projections of which transversely aligned outer side portions of the guard may be fit as it depends from its pivotal connection to the upper ends of the arms 147 and 148.

In the latched position of the guard 170, from its upper end to a point just below the latches 180, 182 the guard has a generally planar configuration and the plane thereof is fixed in adjacent parallel relation to the plane defined by the outermost surfaces 150 of the arms 147 and 148. At the same time the obliquely projected lowermost end portion 178 of the guard is located at this point immediately below the latches and orients in a plane substantially parallel to the plane of the upwardly and inwardly inclined extension of the panel plate section 134. In addition, the obliquely angled portion 178 of the guard 170 projects forwardly and outwardly of the front of the panel 120 a substantial degree, to the extent that should the heater be tipped forwardly the portion 178 of the guard will encounter the ground surface and tend to keep the operating structure of the heater substantially displaced from the surface underlying the heater. More than this, the fact that the guard is pivoted at its top and latched at its sides and extremely difficult to dislodge inadvertently insures that the chimney 40 will be contained within the body of the heater, even if it should be displaced in the tipping procedure and for that matter under any conditions of overturn of the heater.

Resultingly, by virtue of the configuration and the relationship of the guard to the front panel 120 as well as the profile of the front panel 120 there are multiple benefits. It insures a maximum displacement of the dangerous portions of the heater from any adjacent surface exterior to the heater and inhibits inadvertent displacement of parts to the point and to a location where the danger of fire or damage might readily occur as a result thereof.

A possibly inobvious benefit of the invention structure as above described is that by the configuration of the panel and the interrelation of its guard it is extremely difficult for inquisitive children or adults to accidentally or inadvertently place their fingers or hands in a position to expose them immediately of the dangerous portions of the interior of the heater.

It is of course important that the application of the guard 170 is simple and the mount thereof is secure. The only direction in which the guard may be dislodged from its secured position is upwardly and prior to its upward movement it must be shifted laterally and outwardly. The advantages are believed to be clear and obvious. This is in distinct contrast to the disadvantages inherent in the conventional guard for such a heater which is of a nature that inadvertent displacement thereof can easily occur.

A further benefit of the configuration of the panel 120 is that the operating controls of the heater are recessed, inhibiting inadvertent movement thereof.

When one adds to this the construction of the top of the housing and the relative floating relation of the front of the housing accommodating relative expansion and contraction of the parts insures a simple but highly effective preservation of the integrity of the heater construction and in particular its housing, the benefits of which are believed obvious.

In summary, the invention provides distinct and important improvements and developments in wick heater construction lending a great deal of safety in use thereof and insuring a better and safer distribution of the developed heat in the operation thereof as well as a moderation of the temperature of its exterior parts.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A wick heater comprising a housing including a base, side and back walls, a top and a front panel structure, said front panel structure with said top framing an opening to the interior of said housing to expose a chimney surrounding a wick, means defining a heat reflective surface in backing relation to said chimney, said top including a portion thereof constructed and arranged to contain upper end portions of said front panel and to provide means for relative movement therebetween in correspondence with a relative expansion and contraction thereof in response to the temperatures to which said housing is subjected, said top including a frame portion and at least one insert within said frame portion, said insert being positioned over and in a substantially direct vertical alignment with said chimney and being bounded by and normally spaced from portions of said frame and having therein a plurality of slots arranged in a pattern substantially in correspondence with the shape of the area bounded by said heat reflecting backing surface which has a generally parabolic peripheral outline.

2. A wick heater as in claim 1 characterized in that said slots are arranged to extend in directions which are at right angles to one another.

3. A wick heater as in claim 1 wherein said slots are arranged in rows, among which are interposed slots the lines of which are oriented at right angles to said rows.

4. A wick heater as in claim 1 wherein said slots differ in length, are in a spaced relation and overlap in part.

5. Apparatus as in claim 1 characterized in that said frame includes vent openings in areas thereof adjacent the portion of said frame which bounds said insert.

6. A wick heater comprising a housing including a base, side and back walls, a top and a front panel structure, said front panel structure with said top framing an opening to the interior of said housing to expose a chimney surrounding a wick, means defining a heat reflective surface in backing relation to said chimney, said top including a portion thereof constructed and arranged to contain upper end portions of said front panel and to provide means for relative movement therebetween in correspondence with a relative expansion and contraction thereof in response to the temperatures to which said housing is subjected, said front panel structure having in front elevation a laterally expanded generally rectangular U-shape the lower edge of the bridging portion of which is bent inwardly to and forms a forward extension of said base of said housing, a portion of said bridging portion being inclined upwardly and outwardly of the forwardmost edge of said base to provide outermost surface areas of said bridging portion with which outermost surface areas of the arms of said U shape merge as they incline rearwardly and upwardly therefrom.

7. A wick heater as in claim 6 wherein said U-shaped configuration of said plate structure has integral side portions which are bent inwardly and rearwardly to a substantially parallel relation to form forward extensions of the side walls of said housing and the profile of said integral side portions at their forwardmost edges provides a line which inclines upwardly and outwardly of the base of said plate structure and is then reversely inclined to the upper limit of the arms of said plate structure.

8. Apparatus as in claim 7 wherein said arms of said U-shaped plate structure are substantially U-shaped in horizontal section.

9. Apparatus as in claim 6 wherein said arms of said U-shaped plate structure are substantially U-shaped in horizontal section.

10. A wick heater as in claim 6 wherein facing portions of said arms of the U shape of said plate structure have transversely aligned means adjacent their upper ends providing for the pivotal suspension of a safety guard having a grill-like form and transversely aligned latch means adjacent the lower ends of said arms afford a secure retention of said guard in bridging relation to said opening to the interior of said housing which exposes said chimney and said means defining a heat reflective surface in backing relation to said chimney.

11. A wick heater as in claim 10 characterized in that said safety guard has an extension which in the latched position thereof projects outwardly and forwardly of the forwardmost limit of said plate structure providing the front panel of said housing.

12. A wick heater as in claim 11 wherein said latching means comprise a pair of projections formed integral with and projecting outwardly of each of the facing portions of said arms, one of each pair of said projections being offset upwardly and rearwardly of the other with reference to the outermost surface of said plate structure.

13. A wick heater as in claim 10 wherein said latching means comprise a pair of projections formed integral with and projecting outwardly of each of the facing portions of said arms, one of each pair of said projections being offset upwardly and rearwardly of the other with reference to the outermost surface of said plate structure.

14. A wick heater as in claim 6 wherein said bridging portion of said plate stucture as seen in front elevation has a shallow rearward and upward extension thereof between said arms at their lower limits and a relatively central recessed portion providing for a recessed positioning of controls provided for operation of the heater.

15. A wick heater or comprising a housing including a base, side and back walls, a top and a front panel structure, said front panel structure with said top framing an opening to the interior of said housing to expose a chimney surrounding a wick, means defining a heat reflective surface in backing relation to said chimney, said top including a portion thereof constructed and arranged to contain upper end portions of said front panel and to provide means for relative movement therebetween in correspondence with a relative expansion and contraction thereof in response to the temperature to which said housing is subjected, said front panel structure being an integral plate structure formed to provide a forward extension of said base and said side walls of said housing the outermost surface of which is relatively projected intermediate its vertical limits and has in recessed relation thereto operating controls for said heater.

16. A wick heater comprising a housing including a base, side and back walls, a top and a front panel structure, said front panel structure with said top framing an opening to the interior of said housing to expose a chimney surrounding a wick, means defining a heat reflective surface in backing relation to said chimney, said top including a portion thereof constructed and arranged to contain upper end portions of said front panel and to provide means for relative movement therebetween in correspondence with a relative expansion and contraction thereof in response to the temperatures to which said housing is subjected, said means defining a heat reflective surface mounting perpendicular to a plate providing a second heat reflective surface about said chimney defining a chamber with said base of said housing containing a tank providing therein a supply of fuel and mounting a burner unit embodying a wick arranged to be saturated with said fuel and ignited to produce a flame within said chimney, said plate providing said second heat reflective surface having a flange, portions of which slip fit in hook-like projections from said front panel structure in the assembly thereof to said housing and said front panel structure being connected with the remainder of said housing only in the area of its base.

17. A wick heater comprising a housing including a base, side and back walls, a top and a front panel structure, said front panel structure with said top framing an opening to the interior of said housing to expose a chimney surrounding a wick, means defining a heat reflective surface in backing relation to said chimney, said top including a portion thereof constructed and arranged to contain upper end portions of said front panel and to provide means for relative movement therebetween in correspondence with a relative expansion and contraction thereof in response to the temperature to which said housing is subjected, a blower system including duct means having an air inlet in communication with the environment to the exterior of said housing by way of apertures in said back wall thereof, said duct means including a portion extending through and transverely of said means defining a heat reflective surface to position above said chimney and embodying therein a blower unit and in following relation to said blower unit an expanding duct portion opening to the exterior of said housing through means defining an opening in said front panel structure and said side walls being free of apertures which open to the interior of said housing.

18. A front panel for a wick heater comprising an integral plate structure having in front elevation a laterally expanded generally rectangular U-shaped configuration the lower edge of the bridging portion of which is bent inwardly and rearwardly thereof to form a base for said plate structure, a portion of said bridging portion inclining upwardly and outwardly of the front edge of said base to provide outermost surface areas of said bridging portion with which outermost surface areas of the arms of said U shape merge as they incline rearwardly and upwardly therefrom.

19. Apparatus as in claim 18 wherein said U-shaped configuration of said plate structure, as seen in front elevation, has integral side portions bent inwardly and rearwardly therefrom to assume a substantially parallel relation and form side portions of said arms, the profile of which side portions at their front edges provide a line which inclines upwardly and outwardly of the base of said plate structure and is then reversely inclined to the upper limit of said arms.

20. Apparatus as in claim 18 or 19 wherein said arms are substantially U-shaped in horizontal section.

21. Apparatus as in claim 19 wherein facing portions of said arms have transversely aligned means adjacent their upper ends for the pivotal suspension of a guard formed to substantially bridge the space between said arms and transversely aligned latch means at the innermost ends of said facing portions of said arms are arranged to maintain the guard in a secured relation thereto.

22. Apparatus as in claim 21 wherein said latching means comprise a pair of projections formed integral with and projecting outwardly of each of said facing portions of said arms, one of each pair of which is offset upwardly and rearwardly of the other, with reference to the surface portions of said arms at the front of said plate structure.

23. Apparatus as in claim 22 wherein said bridging portion of said plate structure has a shallow upward and rearward extension thereof between said arms and a laterally centered portion which is recessed to accommodate the positioning within the recess thereof controls for the operation of the heater to which said plate structure is applied.

24. Apparatus as in claim 18 characterized in that a very narrow strip of the outermost surface portion of said plate structure immediately above and generally parallel to the lower edge thereof is recessed and bounded at its upper limit by a slot defining an aperture positioned generally parallel to the base of said plate structure by means of which air might pass from the exterior of said plate structure upwardly of and adjacent the rear surface thereof.

25. A wick heater comprising a housing including a base, side and back walls, a top and a front panel structure, said front panel structure together with said top framing an opening to the interior of said housing to expose a chimney therein surrounding a wick, means defining a heat reflective backing surface in spaced relation to said chimney and facing outwardly of said opening to the interior of said housing, said top being comprised of separate portions which are interconnected by means constructed and arranged to accommodate their relative expansion and contraction while inhibiting their separation, said separate portions of said top including a frame portion and at least one insert which positions over and in a substantially direct vertical alignment with said chimney, said insert being bounded by and normally spaced from portions of said frame to accommodate its relative expansion and contraction as it is affected by the issuance of heat from said chimney or the subsequent absence of such heat, said front panel structure having in front elevation a laterally expanded generally rectangular U shape the lower edge of the bridging portion of which is bent inwardly to and forms a forward extension of said base of said housing, a portion of said bridging portion being inclined upwardly and outwardly of the forwardmost edge of said base to provide outermost surface areas of said bridging portion with which outermost surface areas of the arms of said U shape merge as they incline rearwardly and upwardly therefrom.

26. A wick heater as in claim 25 wherein said U-shaped configuration of said plate structure has integral side portions which are bent inwardly and rearwardly to a substantially parallel relation to form forward extensions of the side walls of said housing and the profile of said integral side portions at their forwardmost edges provides a line which inclines upwardly and outwardly of the base of said plate structure and is then reversely inclined to the upper limit of the arms of said plate structure.

27. Apparatus as in claim 26 wherein said arms of said U-shaped plate structure are substantially U-shaped in horizontal section.

28. Apparatus as in claim 25 wherein said arms of said U-shaped plate structure are substantially U-shaped in horizontal section.

29. A wick heater as in claim 25 wherein facing portions of said arms of the U shape of said plate structure have transversely aligned means adjacent their upper ends providing for the pivotal suspension of a safety guard having a grill-like form and transversely aligned latch means adjacent the lower ends of said arms afford a secure retention of said guard in bridging relation to said opening to the interior of said housing which exposes said chimney and said means defining a heat reflective surface in backing relation to said chimney.

30. A wick heater as in claim 29 characterized in that said safety guard has an extension which in the latched position thereof projects outwardly and forwardly of the forwardmost limit of said plate structure providing the front panel of said housing.

31. A wick heater as in claim 30 wherein said latching means comprise a pair of projections formed integral with and projecting outwardly of each of the facing portions of said arms, one of each pair of said projections being offset upwardly and rearwardly of the other with reference to the outermost surface of said plate structure.

32. A wick heater as in claim 29 wherein said latching means comprise a pair of projections formed integral with and projecting outwardly of each of the facing portions of said arms, one of each pair of said projections being offset upwardly and rearwardly of the other with reference to the outermost surface of said plate structure.

33. A wick heater as in claim 25 wherein said bridging portion of said plate structure as seen in front elevation has a shallow rearward and upward extension thereof between said arms at their lower limits and a relatively central recessed portion providing for a recessed positioning of controls provided for operation of the heater.

34. A wick heater comprising a housing including a base, side and back walls, a top and a front panel structure, said front panel structure together with said top framing an opening to the interior of said housing to expose a chimney therein surrounding a wick, means defining a heat reflective backing surface in spaced relation to said chimney and facing outwardly of said opening to the interior of said housing, said top being comprised of separate portions which are interconnected by means constructed and arranged to accommodate their relative expansion and contraction while inhibiting their separation, said separate portions of said top including a frame portion and at least one insert which positions over and in a substantially direct axial alignment with said chimney, said insert being bounded by and normally spaced from portions of said frame to accommodate its relative expansion and contraction as it is affected by the issuance of heat from said chimney or the subsequent absence of such heat, said front panel structure being an integral plate structure formed to provide a forward extension of said base and said side walls of said housing the outermost surface of which is relatively projected intermediate its vertical limits and has in recessed relation thereto operating controls for said heater.

35. A wick heater comprising a housing including a base, side and back walls, a top and a front panel structure, said front panel structure together with said top framing an opening to the interior of said housing to expose a chimney therein surrounding a wick, means defining a heat reflective backing surface in spaced relation to said chimney and facing outwardly of said opening to the interior of said housing, said top being comprised of separate portions which are interconnected by means constructed and arranged to accommodate their relative expansion and contraction while inhibiting their separation, said separate portions of said top including a frame portion and at least one insert which positions over and in a substantially direct vertical alignment with said chimney, said insert being bounded by and normally spaced from portions of said frame to accommodate its relative expansion and contraction as it is affected by the issuance of heat from said chimney or the subsequent absence of such heat, a blower system including duct means having an air inlet in communication with the environment to the exterior of said housing by way of apertures in said back wall thereof, said duct means including a portion extending through and transversely of said means defining a heat reflective surface to position above said chimney and embodying therein a blower unit and in following relation to said blower unit an expanding duct portion opening to the exterior of said housing through means defining an opening in said front panel structure and said side walls being free of apertures which open to the interior of said housing.

* * * * *

UNITED STATES PATENT AND TRADEMARK OFFICE

CERTIFICATE OF CORRECTION

PATENT NO. : 4,474,166

DATED : October 2, 1984

INVENTOR(S) : Robert F. Shaftner and Michael A. Kagan

It is certified that error appears in the above-identified patent and that said Letters Patent is hereby corrected as shown below:

Col. 2, line 6, "features" is corrected to read -- feature --;

line 42, "faimilar" is corrected to read -- familiar --.

Col. 5, line 45, "of" is corrected to read -- on --.

Col. 6, line 38, "equidistance" is corrected to read -- equidistant --;

line 53, "inert" is corrected to read -- -- insert --.

Col. 7, line 6, "configurated" is corrected to read -- configured --.

Col. 8, line 48, "projections" is corrected to read -- projection --.

Col. 11, line 28, "iinto" is corrected to read

UNITED STATES PATENT AND TRADEMARK OFFICE

CERTIFICATE OF CORRECTION

PATENT NO. : 4,474,166

DATED : October 2, 1984

INVENTOR(S) : Robert F. Shaftner and Michael A. Kagan

It is certified that error appears in the above-identified patent and that said Letters Patent is hereby corrected as shown below:

-- into --.

Col. 12, line 66, "25" is corrected to read -- 26 --.

Col. 13, line 25, "25" is corrected to read -- 26 --.

Col. 16, line 45, -- or -- is deleted.

Col. 17, line 29, "temperature" is corrected to read -- temperatures --.

Signed and Sealed this

Ninth Day of April 1985

[SEAL]

*Attest:*

DONALD J. QUIGG

*Attesting Officer* *Acting Commissioner of Patents and Trademarks*